US007156681B2

(12) United States Patent
Kaneda et al.

(10) Patent No.: US 7,156,681 B2
(45) Date of Patent: Jan. 2, 2007

(54) PLUG ATTACHING MECHANISM

(75) Inventors: Atsushi Kaneda, Kanagawa (JP); Ryota Matsumoto, Tokyo (JP); Toshihiko Fujii, Gunma (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 10/768,786

(22) Filed: Jan. 30, 2004

(65) Prior Publication Data

US 2004/0229515 A1 Nov. 18, 2004

(30) Foreign Application Priority Data

Feb. 7, 2003 (JP) ..... P2003-031715

(51) Int. Cl.
*H01R 13/625* (2006.01)

(52) U.S. Cl. ..... 439/332; 439/316; 439/588

(58) Field of Classification Search ..... 439/314, 439/316, 319, 332, 337, 588
See application file for complete search history.

(56) References Cited

U.S. PATENT DOCUMENTS

| | | | | |
|---|---|---|---|---|
| 4,531,800 | A * | 7/1985 | Avener | 439/373 |
| 4,940,424 | A * | 7/1990 | Odbert | 439/369 |
| 5,118,303 | A * | 6/1992 | LeBaron et al. | 439/286 |
| 5,259,782 | A * | 11/1993 | Giffin | 439/367 |
| 5,338,211 | A * | 8/1994 | Kodama et al. | 439/135 |
| 5,378,882 | A * | 1/1995 | Gong et al. | 235/462.45 |
| 5,714,963 | A * | 2/1998 | Cox | 343/786 |
| 6,297,741 | B1 * | 10/2001 | Higgins | 340/631 |

* cited by examiner

*Primary Examiner*—Thanh-Tam Le
(74) *Attorney, Agent, or Firm*—Lerner, David, Littenberg, Krumholz & Mentlik, LLP

(57) ABSTRACT

Apparatus to hang a portable audio equipment that outputs audio signals from the user's neck includes a plug shell provided with a connecting terminal fixed to the inside of a cylindrical plug cover through a sleeve formed of an elastic member. A projecting portion is integrally formed on the connecting terminal side of the plug cover and in the projecting portion is formed an engaging groove that engages with an engaging piece provided on the jack side.

1 Claim, 9 Drawing Sheets

PLUG ATTACHING MECHANISM

BACKGROUND OF THE INVENTION

1. Field of the Invention

The present invention relates to a plug attaching mechanism suitable for use in hanging from the user's neck portable audio equipment or similar that reproduces, for example, audio signals using earphones.

2. Description of the Related Art

In order to hang from the user's neck portable audio equipment that reproduces audio signals using earphones, a mechanism shown in a patent document 1 has conventionally been proposed.

[Patent Document 1]

Japanese Published Patent Application No. 2002-16995 However, when the mechanism of the Patent document 1 is used to hang portable audio equipment from the user's neck, as shown in FIG. 1, the portable audio equipment is bound and fixed with the code 5 provided at the end of the hanging means (neck strap) 1 and the plug 6 is inserted into the jack of the portable audio equipment. As a result, there remain such disadvantages that the mechanism is comparatively complicated for use and unfriendly to the user.

In light of the above, the present invention has an object to provide a mechanism, with which portable audio equipment outputting audio signals is hung from the user's neck in a comparatively simple construction with user-friendliness.

SUMMERY OF THE INVENTION

A plug attaching mechanism according to the present invention includes a plug shell provided with a connecting terminal, which is fixed through a sleeve formed of an elastic member to the inside of a plug cover in cylindrical shape; and on the side of the connection terminal of the plug cover a projecting portion is integrally provided, where an engaging groove that engages with an engaging piece provided on the jack side is formed.

According to the present invention, only by engaging the engaging piece on the jack side with the engaging groove of the projecting portion of the plug cover, a portable audio equipment, for example, can be secured and fixed to this plug cover and also the connection terminal of the plug can be inserted into the jack to be connected, thereby improving the usability with a simple construction.

DESCRIPTION OF THE PREFERRED EMBODIMENT

Hereinafter, an embodiment of a plug attaching mechanism according to the present invention will be explained referring to accompanied drawings.

Figure 8:
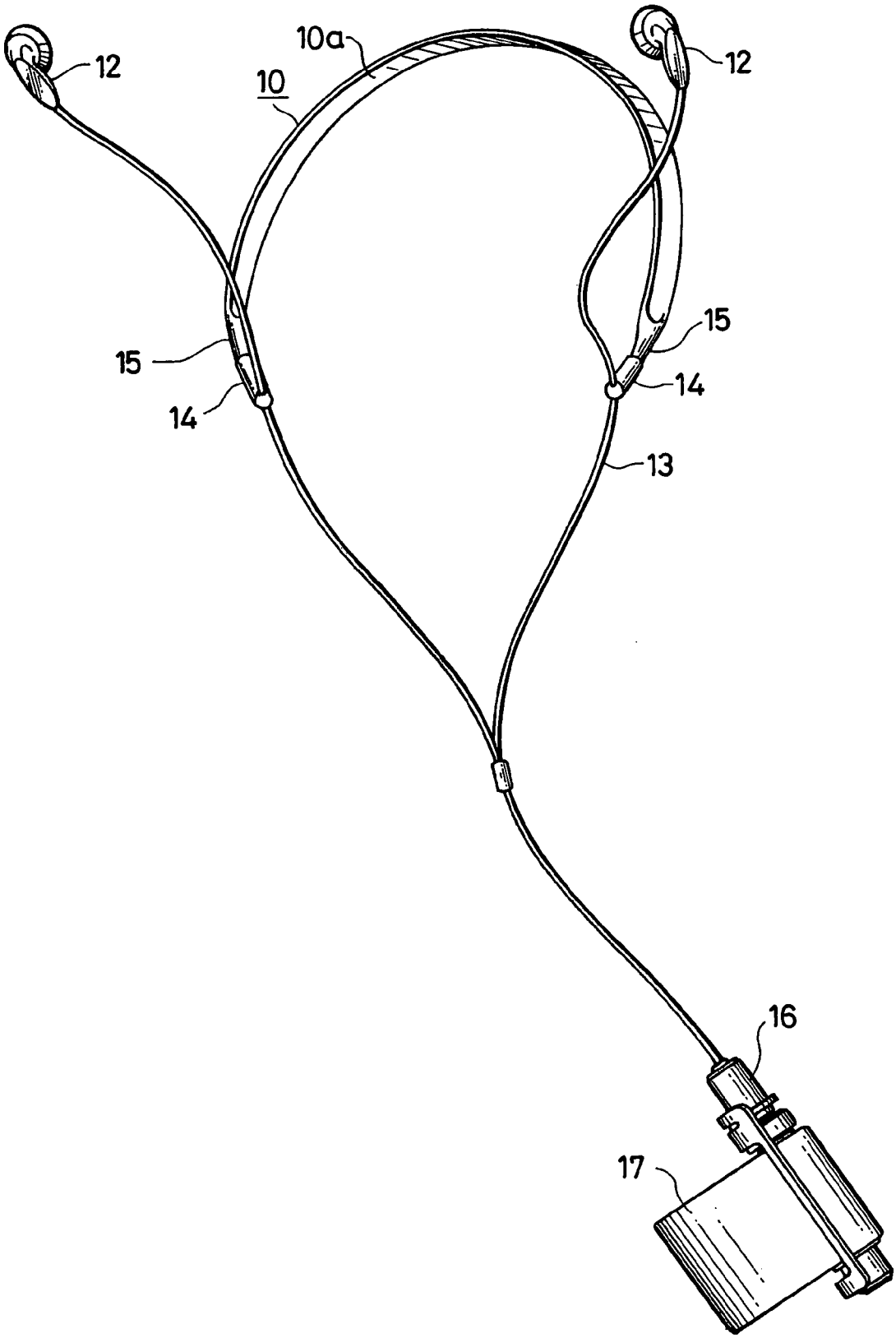
FIG. 8 is a perspective view showing an example of a state in which an embodiment of the plug attaching mechanism according to the present invention is being used.
Figure 9:
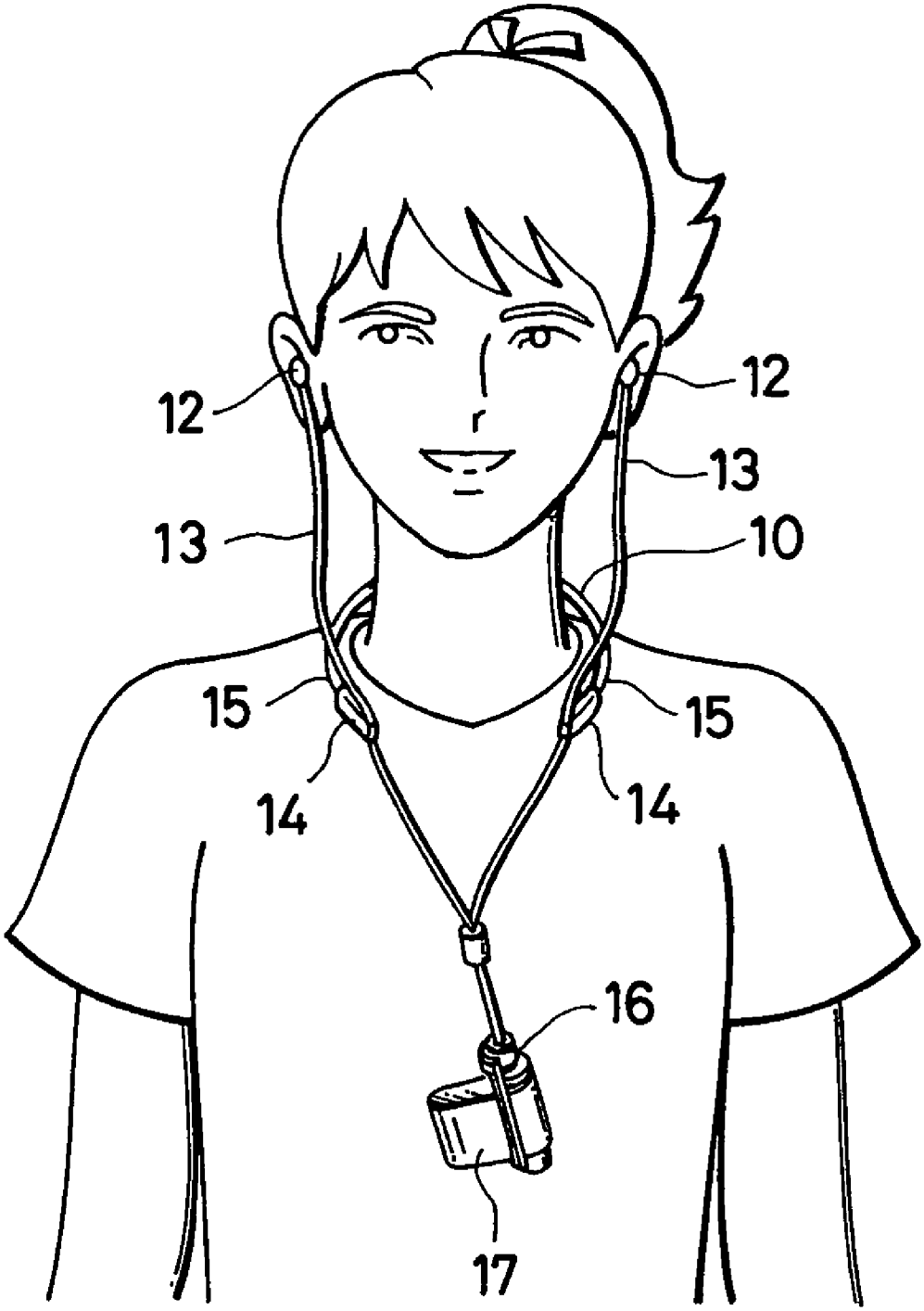
FIG. 9 is a diagram showing an example of a state in which an embodiment of the plug attaching mechanism according to the present invention is being used.

As shown in FIGS. 8, 9, and 10, in this embodiment a portable audio equipment 17 outputting audio signals is hung from the user's neck to be used, and a code 13 of earphones 12 is fixed to a neck strap 10 and the portable audio equipment 17 is attached to a plug portion provided at the end of the code 13 of earphones 12.

In FIGS. 8, 9, and 10, numeral 10*a* denotes a band member formed of synthetic resin having elasticity, such as elastomer, plastic or the like. The length of the band member 10*a* is selected to be a length approximately around the user's neck and in the vicinity of the central part of the band member 10*a* is band-shaped.

Figure 10A:
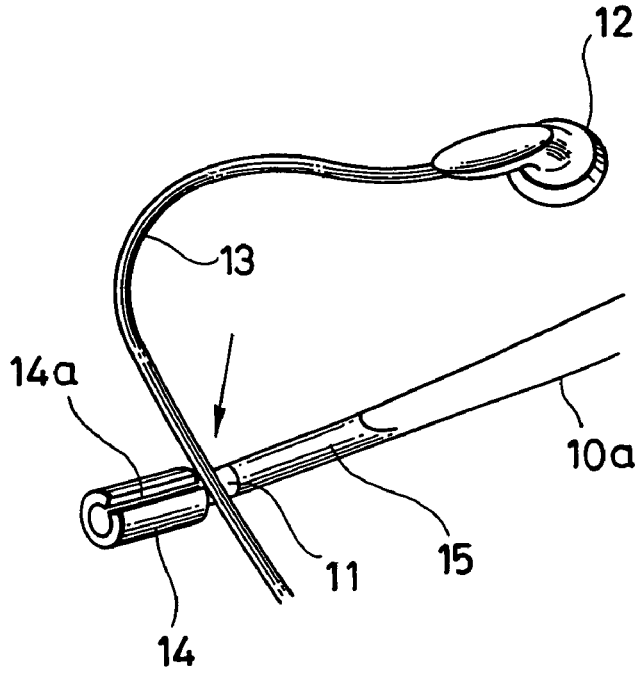
FIGS. 10A and 10B are diagrams provided to explain an example of a neck strap.

At the both ends of the band member 10*a*, there are provided thin portions 11 receiving the code 13 of the earphones 12, as shown in FIG. 10A. The length of the thin portion 11 is made a little shorter than the circumferential length of the code 13, and when the thin portion 11 is folded with holding the code 13, the code 13 is secured by the thin portion 11 and with friction the code 13 is prevented from slipping off the thin portion 11.

At the respective free end sides of the thin portions 11 of the band member 10*a*, a pipe portion 14 having a slit 14*a* is provided. The pipe portions 14 are integrally formed with the band member 10*a*. In this case, the slit 14*a* is formed on the side opposite to the side of the pipe portion 14 connecting to the thin portion 11.

Further, on the opposite side to the free end side of the thin portion 11, an axis portion 15 engaging with the pipe portion 14 formed with the slit 14*a* is provided. The axis portion 15 has a columnar shape, so that rigidity thereof is larger than the thin portion 11 and the pipe portion 14. The thin portion 11, pipe portion 14, and axis portion 15 are integrally formed with the band member 10 using synthetic resin.

Figure 10B:
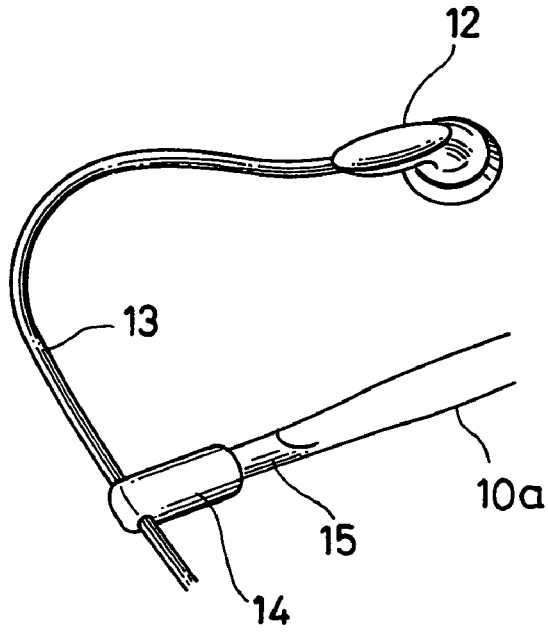

Here, when the pipe portion 14 is folded at the thin portion 11 and predetermined force is applied thereto, by means of the slit 14*a* the axis portion 15 is engaged with the pipe portion 14 which embraces and secures the axis portion 15. In this embodiment, as shown in FIG. 10B, the code 13 of the earphones 12 is received by the thin portion 11, and the pipe portion 14 is folded at the thin portion 11 to be engaged with the axis portion 15.

By means of a plug attaching mechanism according to this embodiment, a plug provided at the end, where the right and left codes 13, 13 of the right and left earphones 12, 12 are united, is connected to a jack of the portable audio equipment 17 which is comparatively light in weight and small-sized, and the portable audio equipment 17 is fixed and secured.

Hereinafter, the plug attaching mechanism according to the embodiment of the present invention is explained referring to FIGS. 2 through 7.

In FIGS. 2 through 7, numeral 16 denotes a plug cover formed of comparatively hard synthetic resin such as ABS resin or the like in a cylindrical shape, through which a plug of earphones 12 formed of a connecting terminal 20 and a plug shell 21 penetrates; and one side of the cylindrical plug cover 16, that is, the side of earphones 12 is narrowed toward the end thereof, so that the plug is prevented from being disengaged from the one side of the plug cover 16, when the later described sleeve 22 is wrapped around the plug shell 21 of the plug.

Figure 1:
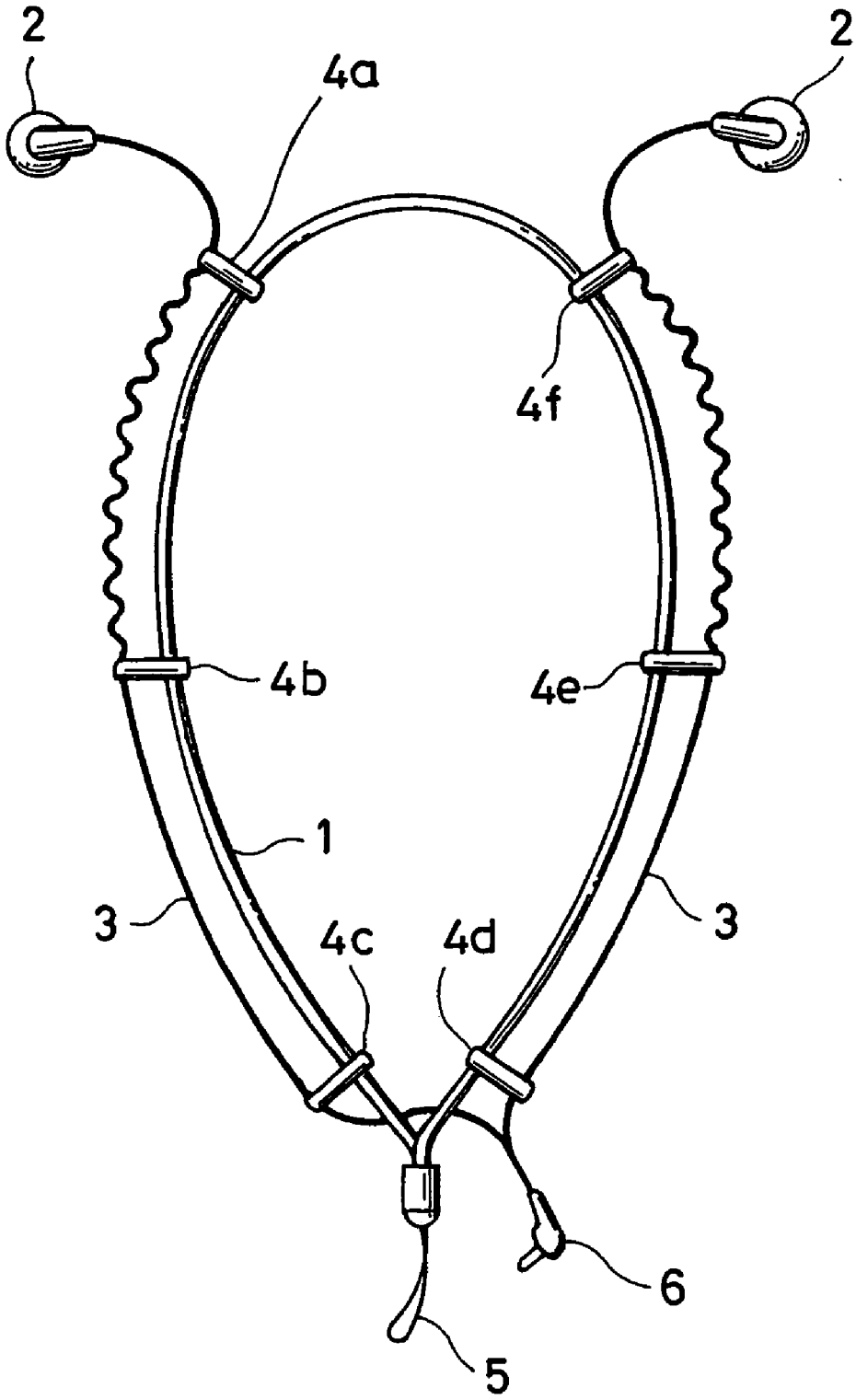
FIG. 1 (RELATED ART)
FIG. 1 is a diagram provided to explain a related art.
Figure 2:
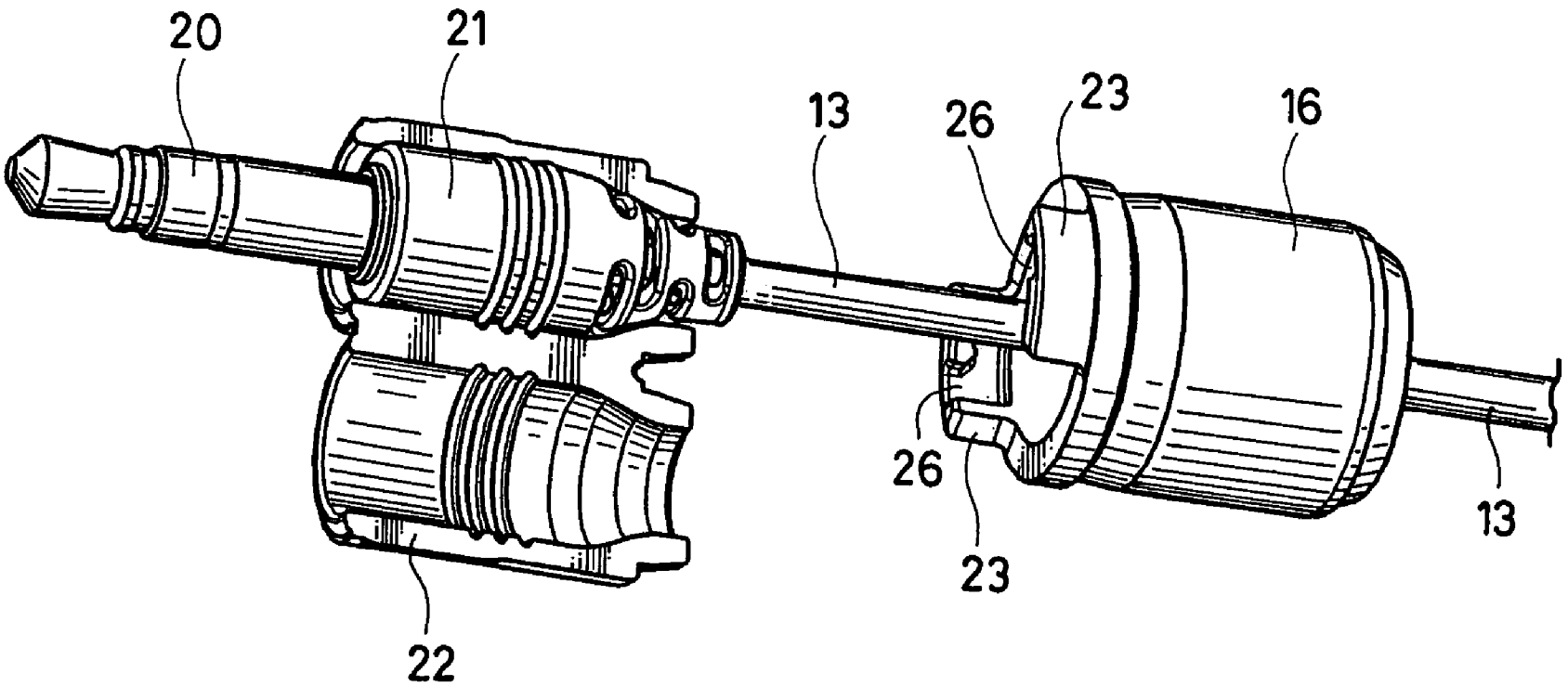
FIG. 2 is an exploded perspective view showing a relevant part of an embodiment of a plug attaching mechanism according to the present invention.
Figure 3:
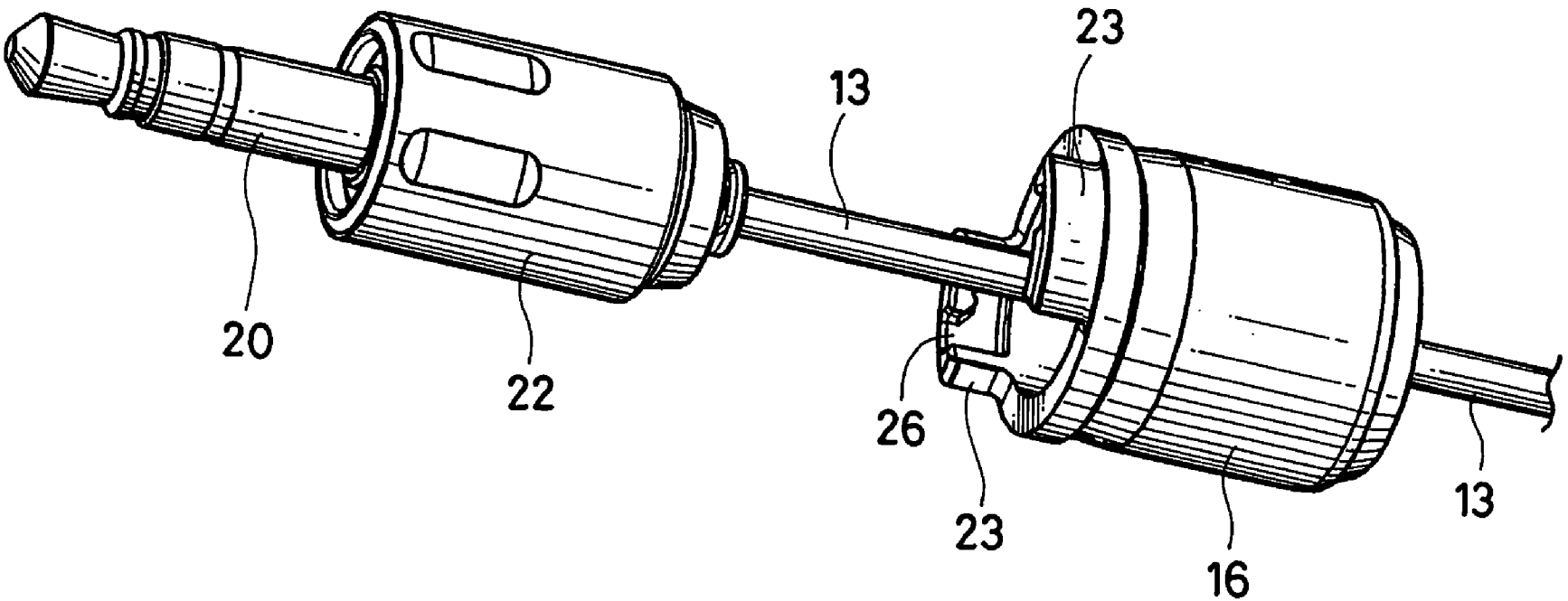
FIG. 3 is an exploded perspective view showing a relevant part of an embodiment of the plug attaching mechanism according to the present invention.
Figure 4:
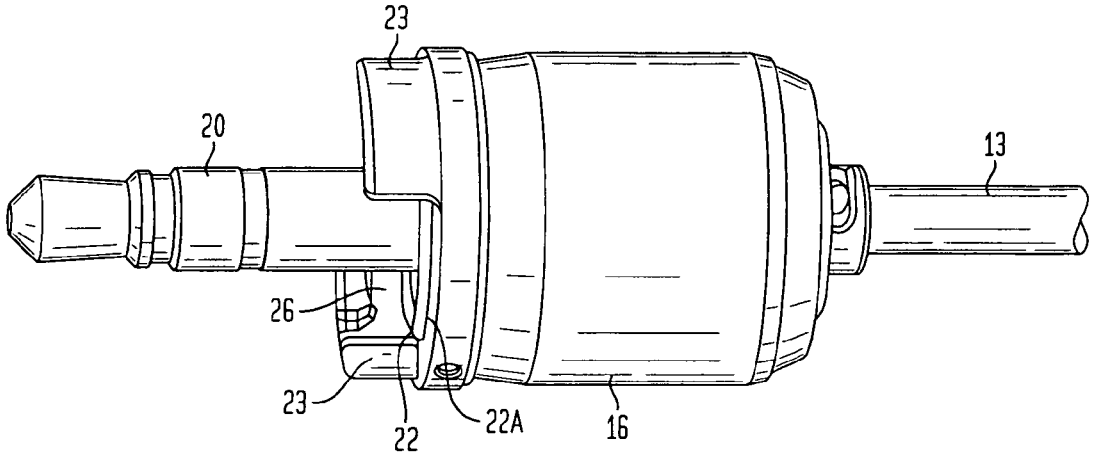
FIG. 4 is a perspective view showing a relevant part of an embodiment of the plug attaching mechanism according to the present invention.

As shown in FIGS. 2 and 3, the sleeve 22 formed of an elastic member such as rubber, elastomer, or the like is wrapped around the plug shell 21 of the plug; and as shown in FIG. 3, the sleeve 22 is wrapped around the plug shell 21 of the plug and then the plug shell 21 is pushed into the plug cover 16, thereby securing and fixing the plug, as shown in FIG. 4.

Figure 5:
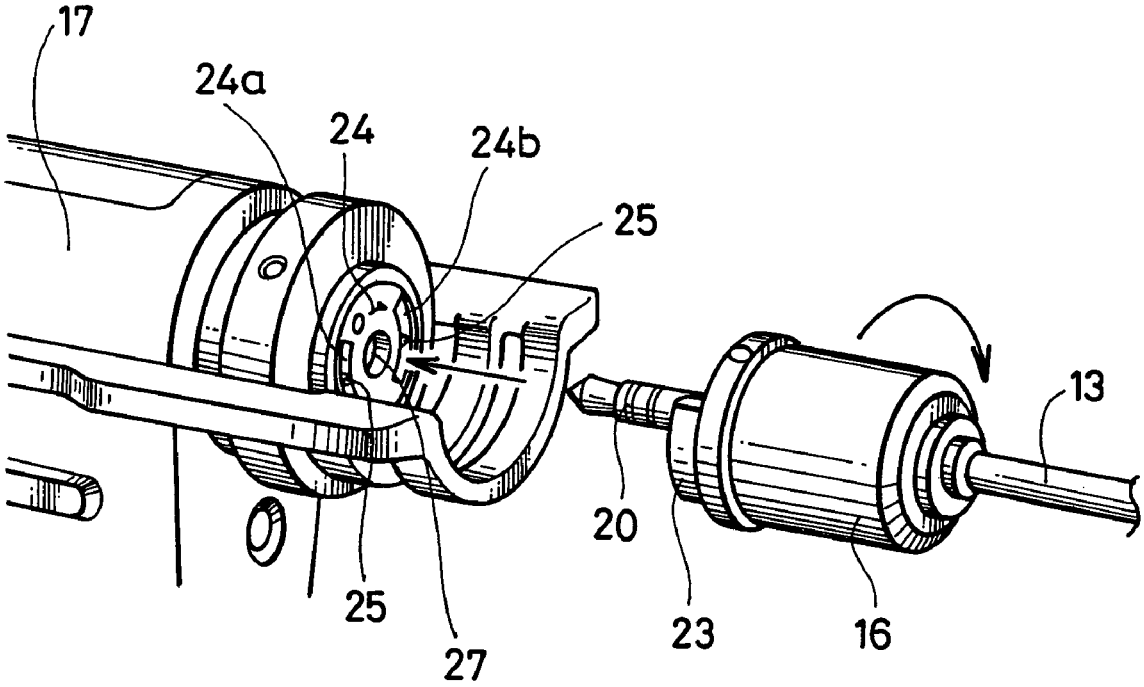
FIG. 5 is a constitutional view of an embodiment of the plug attaching mechanism according to the present invention.

Further, as shown in FIG. 4, two projecting portions 23, 23 are integrally provided at positions opposing to each other on the connecting terminal 20 side of the plug of the plug cover 16 which secures the plug to be fixed; and the projecting portions 23, 23 can be inserted into concave portions 24*a* and 24*b* formed at symmetric positions on an attachment plate 24 in a disc shape fixed to the outside of a jack of the portable audio equipment 17, as shown in FIG. 5. Also, as shown in FIG. 5, on the inside of the respective projecting portions 23, 23 there is formed an L-shaped engagement groove 26 which engages with an engaging piece 25 respectively provided in the concave portions 24*a* and 24*b* of the disc-shaped attachment plate 24.

In FIG. 5, numeral 27 denotes a jack hole constituting the jack provided at the center of the disc-shaped attachment plate 24, into which the connecting terminal 20 of the plug is inserted.

Further, in this embodiment and as shown in FIG. 4, a portion 22A of the sleeve 22 is made to project by a predetermined length from the connecting terminal 20 side of the plug cover 16, when the plug shell 21 of the plug is wrapped with the sleeve 22 and fixed to the inside of the plug cover 16; and with elasticity of the projected portion of the sleeve 22 the engaging pieces 25 provided in the attachment plate 24 on the jack side are secured and fixed to the L-shaped engaging grooves 26 of the projecting portions 23, 23 of the plug cover 16.

Figure 6:
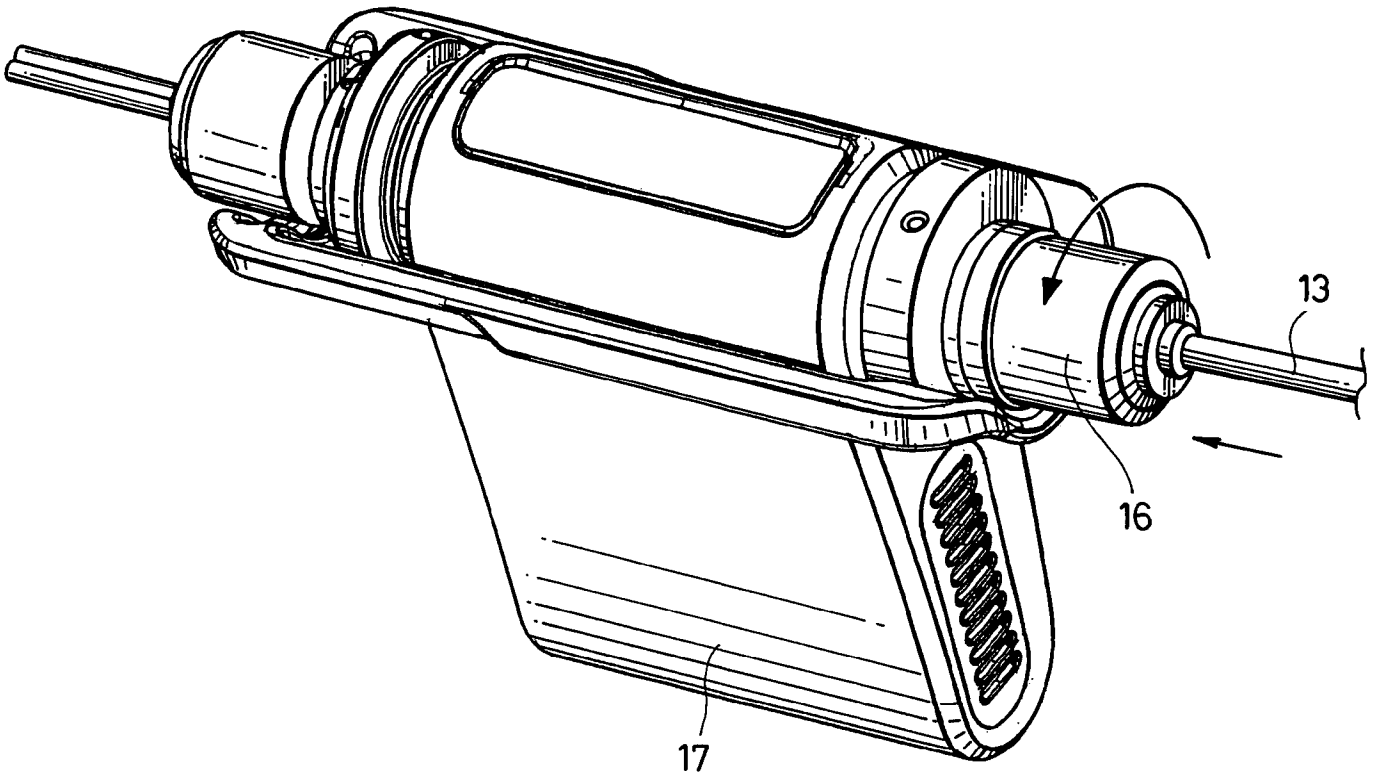
FIG. 6 is a perspective view showing an example of the attached state of the plug attaching mechanism according to the present invention.

In this case, the connecting terminal 20 of the plug fixed to the inside of the plug cover 16 is inserted into the jack hole 27, and the projecting portions 23, 23 are inserted into the concave portions 24*a*, 24*b* of the attachment plate 24, such that the engaging pieces 25 provided on the attachment plate 24 of the jack side come along the L-shaped engaging grooves 26 formed at the projecting portions 23 of the plug cover 16. Then, as shown in FIGS. 5 and 6, when turned along the L-shaped engaging grooves 26 in the direction indicated by an arrow, the engaging pieces 25 and engaging grooves 26 are engaged to connect the connecting terminal 20 to the jack of the portable audio equipment 17 and also the portable audio equipment 17 is held and secured with the plug cover 16.

Figure 7:
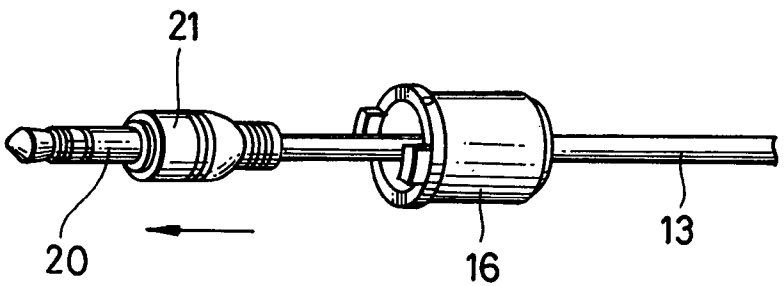
FIG. 7 is a diagram provided to explain the present invention.

Since the plug attaching mechanism according to the embodiment of the present invention is constructed as described above, when by means of the plug attaching mechanism according to the embodiment the portable audio equipment 17 is held and secured, as shown in FIG. 8, to the plug portion of the earphones 12, 12, the codes 13, 13 of which are fixed to the neck strap 10 and the connecting terminal 20 of the plug is inserted into the jack of the portable audio equipment 17, the plug formed of the connecting terminal 20 of the earphones 12, 12 and the plug shell 21 first penetrates through the inside of the plug cover 16 in cylindrical shape, as shown in FIG. 7.

Next, as shown in FIGS. 2 and 3, the sleeve 22 formed of an elastic member is wrapped around the plug shell 21 of the plug, and then, as shown in FIG. 4, the plug in which the sleeve 22 is wrapped around the plug shell 21 is pushed into the plug cover 16 to secure the plug to the inside of the plug cover 16.

Then, as shown in FIG. 5, the connecting terminal 20 fixed to the inside of the plug cover 16 is inserted into the jack hole 27, and the projecting portions 23, 23 of the plug cover 16 are inserted into the concave portions 24*a*, 24*a* of the disc-shaped attachment plate 24 which is fixed to the outside of the jack of the portable audio equipment 17, such that the engaging pieces 25, 25 provided at the concave portions 24*a* and 24*b* of the attachment plate 24 come along the L-shaped engaging groove 26, 26 formed on the projecting portions 23, 23.

Thereafter, as shown in FIGS. 5 and 6, when turned in the direction indicated by the arrow such that the engaging pieces 25, 25 of the attachment plate 24 come along the L-shaped engaging grooves 26, 26 of the projecting portion 23, 23, the engaging pieces 25, 25 and the engaging groove 26, 26 are engaged to connect the connecting terminal 20 to the jack of the portable audio equipment 17 and to hold and secure the portable audio equipment 17 to the plug cover 16.

In this embodiment, since the sleeve 22 is made to project by a predetermined length from the side of the connecting terminal 20 of the plug cover 16, by means of the elasticity of the projected portion of the sleeve 22 the engaging pieces 25, 25 and the engaging grooves 26, 26 can further be held and secured firmly.

As described above, according to this embodiment, with a simplified construction in which the engaging pieces 25, 25 on the jack side are engaged with the engaging grooves 26, 26 provided at the projecting portions 23, 23 of the plug cover 16, the portable audio equipment 17 can be held and secured to the plug cover 16; and the connecting terminal 20 of the plug can be connected to the jack of the portable audio equipment 17 to improve the usability.

Moreover, the present invention is not limited to the above described embodiment and various modifications may be employed without departing from the gist thereof.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A plug attaching mechanism for use in holding a portable audio device, said mechanism comprising:

a plug shell provided with a connecting terminal extending therefrom and having an elastometric sleeve wrapped there around, said connecting terminal being coupled to an earphone and operable to be inserted into said portable audio device, said plug shell and said sleeve being arranged inside of a cylindrical plug cover, said plug cover having integrally formed thereon a pair of projecting portions provided on a connecting terminal side thereof; and a pair of L-shaped engaging grooves formed respectively in said pair of projecting portions for engaging respectively with a pair of engaging pieces provided on an attachment plate coupled to said portable audio device and located at a jack side that receives said connecting terminal, wherein said elastometric sleeve having a protruding portion that protrudes from the plug cover at an end thereof where said pair of projecting portions are located when the elastometric sleeve is arranged inside the plug cover, and wherein said pair of engaging pieces provided on the attachment plate located on the jack side being secured to said pair of L-shaped engaging grooves with an elasticity of said protruding portion of the elastometric sleeve when said portable audio device is engaged.

* * * * *